United States Patent [19]

Frankowski

[11] Patent Number: 4,596,389

[45] Date of Patent: Jun. 24, 1986

[54] TENNIS BALL

[75] Inventor: Richard Frankowski, North Mobile, Ala.

[73] Assignee: The Large Tennis Ball Company, Mobile, Ala.

[21] Appl. No.: 500,892

[22] Filed: Jun. 3, 1983

[51] Int. Cl.[4] ..... A63B 69/38; A63B 39/00

[52] U.S. Cl. ..... 273/29 A; 273/61 R

[58] Field of Search ..... 273/61 R, 60 R, DIG. 20, 273/61 C, 61 D, 61 E, 61 B, 58 K, 29 A, 199 R

[56] References Cited

U.S. PATENT DOCUMENTS

| | | | |
|---|---|---|---|
| 1,011,856 | 12/1911 | Sadler | 273/417 |
| 1,911,125 | 5/1933 | Miller | 273/61 D X |
| 2,210,954 | 8/1940 | Roberts | 273/61 R X |
| 2,706,514 | 4/1955 | Anderson | 273/61 |
| 2,896,949 | 7/1959 | Dunker | 273/61 C |
| 3,039,773 | 6/1962 | Teeguarden et al. | 273/61 R |
| 3,518,786 | 7/1970 | Holtvoigt | 273/DIG. 20 |
| 4,012,041 | 3/1977 | Hoffman | 273/61 D |
| 4,031,688 | 6/1977 | Wasserman | 273/61 D X |
| 4,098,504 | 7/1978 | Koziol | 273/61 |
| 4,101,128 | 7/1978 | Yellen | 273/417 |
| 4,150,826 | 4/1979 | Baldorossi et al. | 273/DIG. 20 X |
| 4,170,352 | 10/1979 | Vcala | 273/61 |
| 4,201,384 | 5/1980 | Barber | 273/199 |
| 4,240,630 | 12/1980 | Hoffman | 273/61 D X |
| 4,340,222 | 7/1982 | Kerkenbush et al. | 273/61 R |

FOREIGN PATENT DOCUMENTS

| | | | |
|---|---|---|---|
| 2639749 | 3/1976 | Fed. Rep. of Germany | 273/DIG. 20 |
| 854595 | 11/1960 | United Kingdom | 273/61 R |

*Primary Examiner*—George J. Marlo

*Attorney, Agent, or Firm*—Anthony J. DeLaurentis

[57] ABSTRACT

A tennis ball whose weight is preferably equal to the weight of a conventional or regulation tennis ball and whose diameter is from about 2.800 inches to about 3.500 inches, the ball thus being larger in diameter than a conventional ball so as to encounter increased air resistance during flight, thereby to slow the pace of a game being played with the ball relative to the pace of a game being played with a conventional ball of smaller diameter.

1 Claim, 3 Drawing Figures

TENNIS BALL

BACKGROUND OF THE INVENTION

The present invention relates to the game of tennis and, in particular, to a ball which can be used to slow the pace of the game for teaching and practicing purposes, and for normal play by participants seeking a somewhat slower than conventional pace.

In the game of tennis, as is the case with many of the games or sports being played on a competitive level, there is a trend toward increasing the pace of play. This is fine for experienced participants or for participants in their physical prime, but for less physically active participants, such as those of advanced age or those suffering from minor injuries or disabilities, or for participants who are inexperienced or merely desirous of a more "social" game, it is desirable to provide some means for controlling or slowing the pace of the game.

It is also desirous to provide means for simplifying the game so that it will be rewarding to a wider range of participants.

To this latter end numerous developments have been made in the equipment used in the game of tennis. For example, larger rackets have been developed so as to provide a larger hitting area with which to contact the ball. Tennis balls also have been modified, for example, to bounce more consistently over a period of time. Tennis balls also have been made in colors such as yellow or orange, which can be seen more easily than the once conventional white or off-white balls, and recently, tennis balls have been made in contrasting colors so that the spin on the ball can be seen more easily. This latter feature, i.e., contrasting colors is disclosed, for example, in U.S. Pat. No. 4,170,352 to Vcala.

OBJECTS AND SUMMARY OF THE INVENTION

While the above and other improvements no doubt represent advances in the game of tennis, they do nothing for the participant who requires a game of relatively slower pace. Accordingly, it is an object of the present invention to provide a tennis ball that will move through the air at a slower pace than a conventional ball under the influence of an impact of equal force.

It is another object of the invention to provide a tennis ball which is colored so as to facilitate its being seen during play.

It is yet another object to provide a visual or training aid for indicating the spin of the ball while it is in flight, while simultaneously slowing the flight relative to the speed of an otherwise conventional ball.

In accordance with this invention these and other objects and advantages are achieved by providing a tennis ball which is from about 2.800 inches to about 3.500 inches in diameter and which is of substantially the same weight as a conventional ball, for example, about 2 to 2½ oz. (56.70–72.87 grams). In this regard, the International Lawn Tennis Federation requires that the following specifications be met at a temperature of 20° C. and a relative humidity of 60%:

(1) Diameter (go-no-go" gauges), 2.575–2.700 inches (65.4–68.6 mm); and (2) Weight 2–2 1/16 (56.70–58.47 g).

(3) Rebound from 100 in (2.54 m) on to concrete, 53–58 in. (1.35–1.47 m).

(4) (a) Deformation under 18 lbf (8.2 kgf) load, 0.230–0.290 in. (5.85–7.35 mm).

(b) Deformation under 18 lbf (8.1 kgf) load on recovery after ball has been compressed through 1 in. (25.4 mm), 0.355–0.425 in. (9–10.8 mm). (see U.S. Pat. No. 4,098,504 to Kozeol, incorporated herein by reference).

This relative change in size will result in increased wind resistance during flight, thus causing the ball to move more slowly.

In order to provide the desired visual effects, the tennis balls of this invention would be colored pink, yellow, orange or some other readily visible color. In a preferred embodiment, the tennis balls would, in addition to being of larger diameter than conventional balls, have a cover comprised of a plurality of panels of contrasting color. In the alternative, the cover may comprise seams which are colored so as to contrast with the remainder of the cover. It will be appreciated that the larger ball having a color contrasting cover and/or seams will both slow the pace of the game being played and enable the player to see the spin on the ball during flight.

DESCRIPTION OF THE PREFERRED EMBODIMENTS

Figure 1:
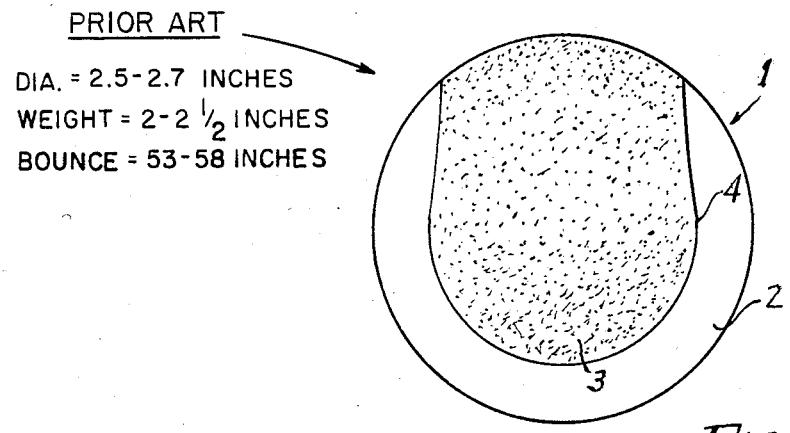
FIG. 1 illustrates a conventional tennis ball having a diameter of about 2.5 to 2.7 inches.

Referring to the various figures of the drawing wherein like numerals will designate like elements throughout, and referring specifically to FIG. 1, there is shown a tennis ball 1 of conventional design and fabrication having outer or cover panel members 2 and 3 and a contiguous seam 4 therebetween. The ball 1 also is conventional in the sense that it meets, for example, International Lawn Tennis Federation specifications, thus having an outside diameter of from 2.575 inches to 2.700 inches, a weight of 2–2 1/16 oz. (56.70–58.47 g), and a rebound from 100 in. on to concrete of 53–58 in.

Figure 2:
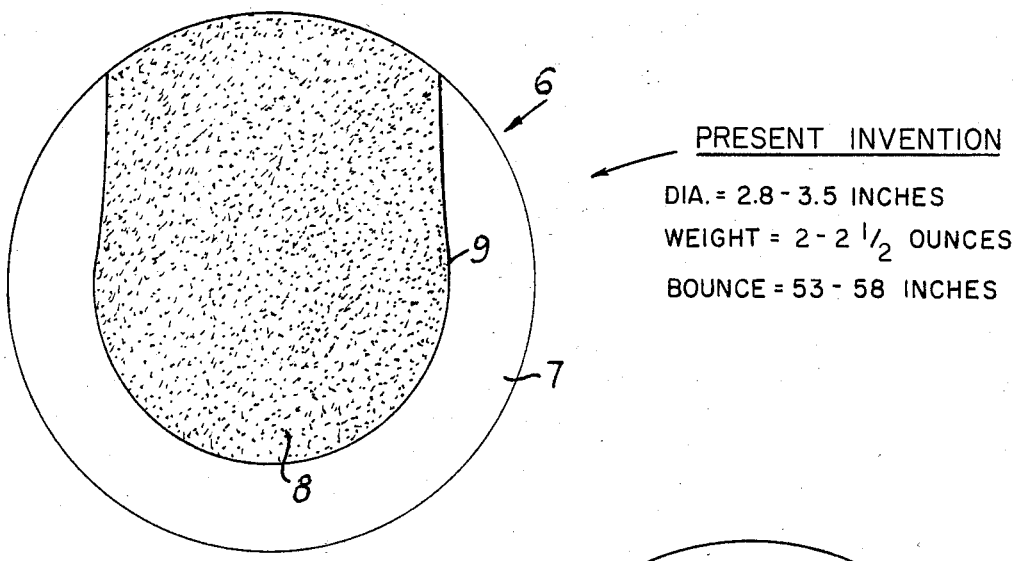
FIG. 2 illustrates a tennis ball in accordance with the present invention, the ball having a diameter on the order of 2.800 inches to about 3.500 inches.

Referring now to FIG. 2, there is shown a ball 6 made in accordance with the present invention. The ball 6 is larger than the ball 1 and has an outside diameter of from about 2.800 inches to about 3.500 inches. In one embodiment, the diameter of the ball 6 is from about 3.000 inches to about 3.500 inches and, in another embodiment diameter is from about 3.250 inches to about 3.500 inches. The ball 6 is made in the same manner as the ball 1, except that the cover panels 7 and 8 are dyed or otherwise provided with contrasting colors. For example, panel 7 may be colored yellow while panel 8 may be colored orange, or vice versa. It will be appreciated, of course, that it is within the scope of this invention to provide panels 7 and 8 with the same color and that any color may be selected.

Figure 3:
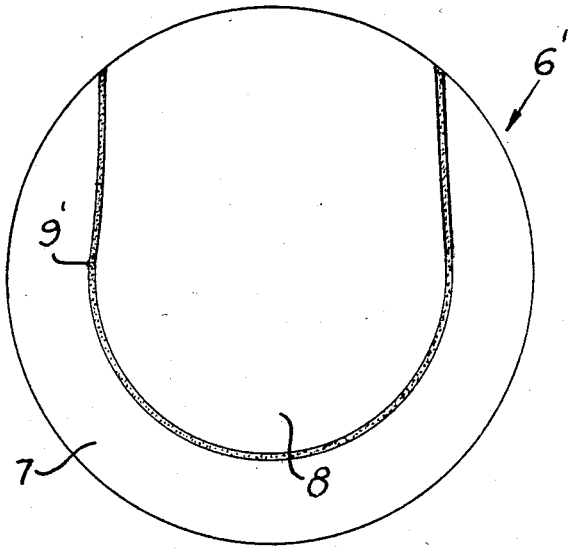
FIG. 3 illustrates another embodiment of a tennis ball in accordance with the invention.

In an alternative embodiment, as illustrated in FIG. 3, the panels 7 and 8 may be the same color, such as white, pink, yellow, or orange, and the seams 9' may be colored with a visually distinct contrasting color. Typically the seams 9' in the embodiment of FIG. 3 would be black, royal blue or some other dark or prominent contrasting color.

It will be appreciated that although a tennis ball of the larger size set forth herein will encounter more air resistance during flight than the conventional smaller ball, and thus will fly more slowly regardless of its color, the contrasting color panels shown in FIG. 2 or the contrasting seams shown in FIG. 3 will provide the added feature of enabling a player to see the rotation of the ball in flight.

The ball of the size disclosed herein will heighten participant interest since it is easier for the participant to play the game at a slower pace. Additionally, the ball having both a larger size and contrasting cover configuration will make the game easier to play not only because of the slower pace, but because the player can see the direction of rotation or spin on the ball.

It is to be understood that the invention has been shown and described herein in what is considered to be illustrative embodiments and that departures therefrom within the scope of the invention may be made and that obvious modifications will occur to a person skilled in the art.

What is claimed is:

1. A hollow tennis ball having a diameter of 2.8–3.5 inches, a weight of 2–2½ ounces, and a rebound from 100 inches onto concrete of 53–58 inches.

* * * * *